US006877570B2

(12) United States Patent
Chen et al.

(10) Patent No.: US 6,877,570 B2
(45) Date of Patent: Apr. 12, 2005

(54) DRILLING WITH CASING

(75) Inventors: Chen-Kang D. Chen, Houston, TX (US); M. Vikram Rao, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 67 days.

(21) Appl. No.: 10/320,164

(22) Filed: Dec. 16, 2002

(65) Prior Publication Data

US 2004/0112639 A1 Jun. 17, 2004

(51) Int. Cl.[7] ..... E21B 7/20
(52) U.S. Cl. ..... 175/22; 175/73; 175/171
(58) Field of Search ..... 175/22, 45, 61, 175/62, 73–75, 107, 171, 263, 265, 384, 385

(56) References Cited

U.S. PATENT DOCUMENTS

| | | | | |
|---|---|---|---|---|
| 1,500,001 A | * | 7/1924 | Walter | 175/286 |
| 3,552,509 A | | 1/1971 | Brown | |
| 3,661,218 A | | 5/1972 | Brown | |
| 5,168,942 A | | 12/1992 | Wydrinski | |
| 5,197,533 A | | 3/1993 | Behrends | |
| 5,271,472 A | | 12/1993 | Leturno | |
| 5,343,964 A | * | 9/1994 | Leroy | 175/61 |
| 6,059,051 A | * | 5/2000 | Jewkes et al. | 175/76 |
| 6,118,531 A | | 9/2000 | Hertel et al. | |
| 6,123,368 A | * | 9/2000 | Enderle | 285/334 |
| 6,269,892 B1 | * | 8/2001 | Boulton et al. | 175/61 |
| 6,470,977 B1 | | 10/2002 | Chen et al. | |
| 6,581,699 B1 | | 6/2003 | Chen et al. | |
| 6,705,413 B1 | * | 3/2004 | Tessari | 175/22 |

OTHER PUBLICATIONS

SPEC/IADC 52789, R.M. (Bob) Tessari, SPE, and Garret. Case Drilling—A Revolutionary Approach to Reducing Well Costs Madell, SPE, Tesco Corporation, Mar. 9–11, 1999, pp. 1–11.

IADC/SPE 62780, E. Skinazi, SPE; R. Deady, SPE; D. Robson; C. Konschuh; Sperry Sun Drilling Services. Development of a Case/ Drilling System Imporves the Drilling Process, IADC/SPE Asia Specific Drilling Technology,Sep. 11–13, 2000, pp. 1–6.

IADC/SPE 67731, S.F. Shepard, SPE, and R.H. Reiley, SPE BP, and T.M Warren, SPE, TESCO Corp., Case Drilling: An Emerging Technology, SPE/IADC Drilling Conference, Feb. 27–Mar. 1, 2001, pp. 1–13.

* cited by examiner

*Primary Examiner*—Kenn Thompson
(74) *Attorney, Agent, or Firm*—Browning Bushman P.C.

(57) ABSTRACT

A borehole may be drilled utilizing the bottom hole assembly 10, 50 with a downhole motor 14, which may offset at a selected bend angle. The motor housing is preferably run slick, and a gauge section 36 secured to the pilot bit 18 has a uniform diameter bearing surface along an axial length of at least 60% of the pilot bit diameter. The bit or reamer 16 has a bit face defining the cutting diameter of the drilled hole. The axial spacing between the bend and the bit face is controlled to less than fifteen times the bit diameter. The downhole motor, pilot bit and bit may be retrieved from the well while leaving the casing string in the well.

39 Claims, 2 Drawing Sheets

DRILLING WITH CASING

FIELD OF THE INVENTION

The present invention relates to technology for drilling an oil or gas well, with the casing string remaining in the well after drilling. More particularly, the present invention relates to techniques for improving the efficiency of drilling a well with casing, with improved well quality providing for enhanced hydrocarbon recovery, and with the technology allowing for significantly reduced costs to reliably complete the well.

BACKGROUND OF THE INVENTION

Most hydrocarbon wells are drilled in successively lower casing sections, with a selected size casing run in a drilled section prior to drilling the next lower smaller diameter section of the well, then running in a reduced diameter casing size in the lower section of the well. The depth of each drilled section is thus a function of (1) the operator's desire to continue drilling as deep as possible prior to stopping the drilling operation and inserting the casing in the drilled section, (2) the risk that upper formations will be damaged by high pressure fluid required to obtain the desired well balance and downhole fluid pressure at greater depths, and (3) the risk that a portion of the drilled well may collapse or otherwise prevent the casing from being run in the well, or that the casing will become stuck in the well or otherwise practically be prevented from being run to the desired depth in a well.

To avoid the above problems, various techniques for drilling a well with casing have been proposed. This technique inherently runs the casing in the well with the bottom hole assembly (BHA) as the well, or a section of the well, is being drilled. U.S. Pat. Nos. 3,552,509 and 3,661,218 disclose drilling with rotary casing techniques. U.S. Pat. No. 5,168,942 discloses one technique for drilling a well with casing, with the bottom hole assembly including the capability of sensing the resistivity of the drilled formation. U.S. Pat. No. 5,197,533 also discloses a technique for drilling a well with casing. U.S. Pat. No. 5,271,472 discloses yet another technique for drilling the well with casing, and specifically discloses using a reamer to drill a portion of the well with a diameter greater than the OD of the casing. U.S. Pat. No. 5,472,051 discloses drilling a well with casing, with a bottom hole assembly including a drill motor for rotating the bit, thereby allowing the operator at the surface to (a) rotate the casing and thereby rotate the bit, or (b) rotate the bit with fluid transmitted through the drill motor and to the bit. Still another option is to rotate the casing at the surface and simultaneously power the drill motor to rotate the bit. U.S. Pat. No. 6,118,531 discloses a casing drilling technique which utilizes a mud motor at the end of coiled tubing to rotate the bit. SPE papers 52789, 62780, and 67731 discuss the commercial advantages of casing drilling in terms of lower well costs and improved drilling processes.

Problems have nevertheless limited the acceptance of casing drilling operations, including the cost of casing capable of transmitting high torque from the surface to the bit, high losses between the surface applied torque and the torque on the bit, high casing wear, and difficulties associated with retrieving the bit and the drill motor to the surface through the casing.

The disadvantages of the prior art are overcome by the present invention, and improved methods of casing drilling are hereinafter disclosed which will result in a casing run in a well during a casing drilling operation, with lower costs and improved well quality providing for lower cost and/or enhanced hydrocarbon recovery.

SUMMARY OF THE INVENTION

The present invention provides for casing drilling, wherein a well is drilled utilizing a bottom hole assembly at the lower end of the casing string and a downhole motor with a selected bend angle, such that the pilot bit and reamer (or bi-centered bit) when rotated by the motor have an axis offset at a selected bend angle from the axis of the power section of the motor. According to the invention, the motor housing may be "slick", meaning that the motor housing has a substantially uniform diameter outer surface extending axially from the upper power section to the lower bearing section. A gauge section is provided secured to the pilot bit, and has a uniform diameter surface thereon along an axial length of at least about 60% of the bit diameter. The reamer may thus be rotated by rotating the casing string at the surface, but may also be rotated by pressurized fluid passing through the downhole motor to rotate the pilot bit and the reamer. The casing string remains in the well and the downhole motor, pilot bit and reamer may be retrieved from the well.

It is a feature of the invention that the pilot bit may be rotated with the casing string to drill a relatively straight section of the wellbore, and that the downhole motor may be powered to rotate the pilot bit with respect to the non-rotating casing string to drill a deviated portion of the wellbore.

Another feature of the invention is that the gauge section secured to the pilot bit may have an axial length of at least 75% of the pilot bit diameter.

Yet another feature of the invention is that the interconnection between the downhole motor and the reamer or bi-centered bit is preferably accomplished with a pin connection at the lower end of the downhole motor and a box connection at the upper end of the reamer.

A significant feature of the present invention is that casing while drilling operations may be performed with the improved bottom hole assembly, with the casing string utilizing relatively standard connections, such as API coupling connections, rather than special connections required for casing while drilling operations utilizing a conventional bottom hole assembly.

Another feature of the present invention is that the bottom hole assembly significantly reduces the risk of sticking the casing in the well, which may cost a drilling operation tens of thousands of dollars.

An advantage of the present invention is that the bottom hole assembly does not require especially made components. Each of the components of the bottom hole assembly may be selected by the operator as desired to achieve the objectives of the invention.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
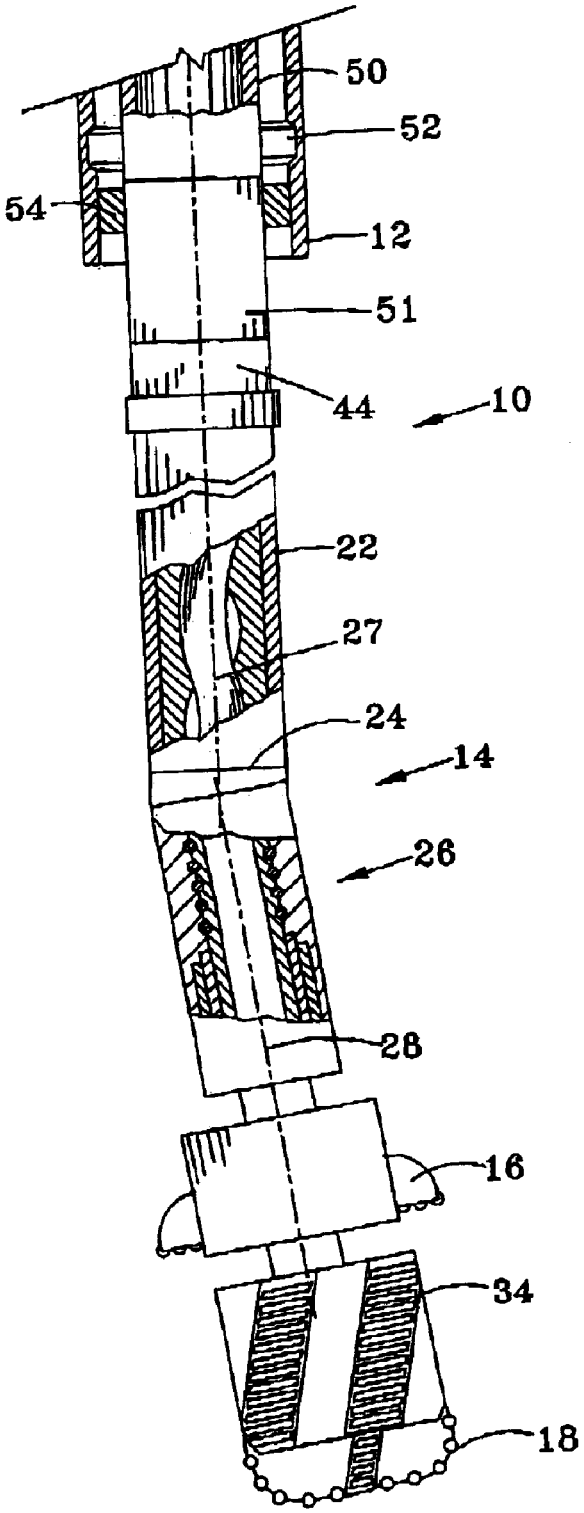
FIG. 1 generally illustrates a well drilled with a bottom hole assembly at the lower end of a casing string and a downhole motor with a bend, a reamer and a pilot bit.

FIG. 1 generally illustrates a well drilled with a bottom hole assembly (BHA) 10 at the lower end of a casing string 12. The BHA 10 includes a fluid powered downhole motor 14 with a bend for rotating a bit 16 to drill a deviated portion of the well. A straight section of the well may be drilled by additionally rotating the casing string 12 at the surface to rotate the bit 16, which as explained subsequently may be either a reamer or a bi-centered bit. To drill a curved section of the borehole, the casing is slid (non-rotating) and the downhole motor 14 rotates the bit 16. It is generally desirable to rotate the casing string to minimize the likelihood of the casing string becoming stuck in the borehole, and to improve return of cuttings to the surface. In the preferred embodiment, a bend in the bottom hole assembly has a bend angle of less than about 3°.

Since the bit 16 which drills the borehole has a cutting diameter greater than the OD of the casing, and since the bit is retrieved through the ID of the casing after the casing is run in the well, the bit in many applications will be a reamer. The bit 16 alternatively may be a bi-centered bit, or any other cutting tool for cutting a borehole diameter greater than the OD of the casing. A pilot bit 18 has a cutting diameter less than the ID of the casing and may be fixed to the bit or reamer 16, with the cutting diameter of the reamer or the bi-centered bit being significantly greater than the cutting diameter of the pilot bit.

The downhole motor 14 may be run "slick", meaning that the motor housing has a substantially uniform diameter from the upper power section 22 through the bend 24 and to the lower bearing section 26. No stabilizers need be provided on the motor housing, since neither the motor housing nor a small diameter stabilizer is likely to engage the borehole wall due to the enlarged diameter borehole formed by the bit 16. The motor housing may include a slide or wear pad. A downhole motor which utilizes a lobed rotor is usually referred to as a positive displacement motor (PDM).

The downhole motor 14 as shown in FIG. 1 has a bend 24 between the upper axis 27 of the motor housing and the lower axis 28 of the motor housing, so that the axis for the bit 16 is offset at a selected bend angle from the axis of the lower end of the casing string. The lower bearing section 26 includes a bearing package assembly which conventionally comprises both thrust and radial bearings.

Figure 2:
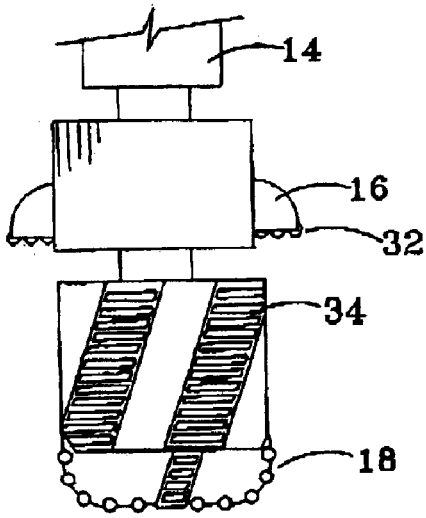
FIG. 2 illustrates in greater detail a pilot bit, a gauge section secured to the pilot bit, and a reamer.
Figure 3:
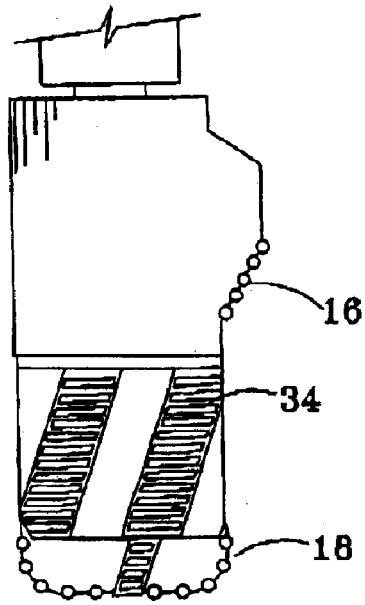
FIG. 3 illustrates a pilot bit, and a gauge section secured to the pilot bit, and a bi-centered bit.

The bit 16, which in many applications will be a reamer, has an end face which is bounded by and defines a bit cutting diameter. When the bit is a reamer, the reamer will have a face which defines the reamer cutting diameter. In either case, the face of the cutters may lie within a plane substantially perpendicular to the central axis of the bit, as shown in FIG. 2, or the cutters could be inclined, as shown in FIG. 3. The bit cutting diameter, in either case, is the diameter of the hole being drilled, and thus the radially outermost cutter's final location defines the bit cutting diameter. The gauge section 34 is below the reamer 16, and is rotatably secured to and/or may be integral with the bit 16 and/or the pilot bit 18. The axial length of the gauge section ("gauge length") is at least 60% of the pilot bit diameter, preferably is at least 75% of the pilot bit diameter, and in many applications may be from 90% to one and one-half times the pilot bit diameter. In a preferred embodiment, the bottom of the gauge section may be substantially at the same axial position as the pilot bit face, but could be spaced slightly upward from the pilot bit face. The top of the gauge section preferably is only slightly below the cuffing face of the bit or reamer 16, although it is preferred that the axial space between the bottom of the gauge section and the pilot bit face is less than the axial spacing between the top of the gauge section and the face of the bit or reamer 16. The diameter of the gauge section may be slightly undergauge with respect to the pilot bit diameter.

The axial length of the gauge section is measured from the top of the gauge section to the forward cutting structure of the pilot bit at the lowest point of the full diameter of the pilot bit, e.g., from the top of the gauge section to the pilot bit cutting face. Preferably no less than 50% of this gauge length forms the substantially uniform diameter cylindrical bearing surface when rotating with the bit. One or more short gaps or undergauge portions may thus be provided between the top of the gauge section of the bottom of the gauge section. The axial spacing between the top of the gauge section and the pilot bit face will be the total gauge length, and that portion which has a substantially uniform diameter rotating cylindrical bearing surface preferably is no less than about 50% of the total gauge length. Those skilled in the art will appreciate that the outer surface of the gauge section need not be cylindrical, and instead the gauge section is commonly provided with axially extending flutes along its length, which are typically provided in a spiral pattern. In that embodiment, the gauge section thus has uniform diameter cylindrical bearing surface defined by the uniform diameter cutters on the flutes which form the cylindrical bearing surface. The gauge section may thus have steps or flutes, but the gauge section nevertheless defines a rotating cylindrical bearing surface. The pilot bit 16 may alternatively use roller cones rather than fixed cutters.

FIG. 2 shows in greater detail a suitable bit 16, such as a reamer, which has a cutting diameter 32. Rotatably fixed to the bit 16 is a gauge section 34 which has a uniform surface thereon providing a uniform diameter cylindrical bearing surface along an axial length of at least 60% of the pilot bit diameter, so that the gauge section and pilot bit 18 together form a long gauge pilot bit. As noted above, the gauge section preferably is integral with the pilot bit, but the gauge section may be formed separate from the pilot bit then rotatably secured to the pilot bit. The reamer 16 would normally be formed separate from then rotatably secured to the gauge section 34, although one could form the reamer body and the gauge section as an integral body. When the reamer is bi-centered at 16, as shown in FIG. 3, the bi-centered bit body preferably is integral with the body of gauge section 34. The gauge section preferably has an axial length of at least 75% of the pilot bit diameter. The bit or reamer 16 may be structurally integral with the gauge section 34, or the gauge section may be formed separate from then rotatably secured to the reamer. The bit or reamer 16 includes cutters which move radially outward to a position typically less than, or possibly greater than, 120% of the casing diameter. In many applications, the radially outward position of the cutters on the reamer will be about 115% or less than the casing diameter. The cutters on the reamer 16 may be hydraulically powered to move radially outward in response to an increase in fluid pressure in the bottom hole assembly. Alternatively, a wireline intervention tool can be lowered in the well to move the cutters radially outward and/or radially inward. In yet other embodiments, the cutters may move radially in response to a J-slot mechanism, or to weight on bit. FIG. 3 illustrates a bi-centered bit 16 replacing the reamer.

Figure 4:
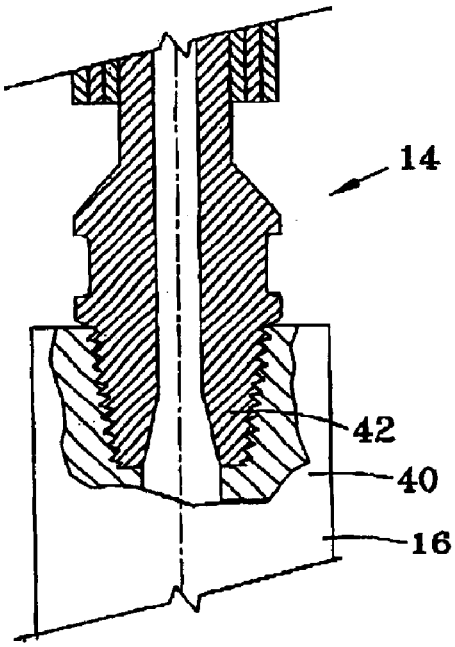
FIG. 4 illustrates a box connection on the reamer connected with a pin connection on the motor.

FIG. 4 depicts a box connection 40 provided on the reamer 16 for threaded engagement with the pin connection 42 at the lower end of the downhole motor 14. The preferred interconnection between the motor and the reamer is thus made through a pin connection on the motor and the box connection on the reamer.

According to the BHA of the present invention, the first point of contact between the BHA and the wellbore is the pilot bit face, and the second point of contact between the BHA and the wellbore is along the axial length of gauge section 34. The third point of contact is the bit or reamer 16, and the fourth point of contact above the downhole motor, and preferably will be along an upper portion of the BHA or along the casing itself. This fourth contact point, is however, spaced substantially above the first, second and third contact points.

BHA 10 as shown in FIG. 1 preferably includes an MWD (measurement-while-drilling) tool 40 in the casing string above the motor 14. This is a desirable position for the MWD tool, since it may be less than about 30 meters, and often less than about 25 meters, between the MWD tool and the end of the casing string 12.

Figure 5:
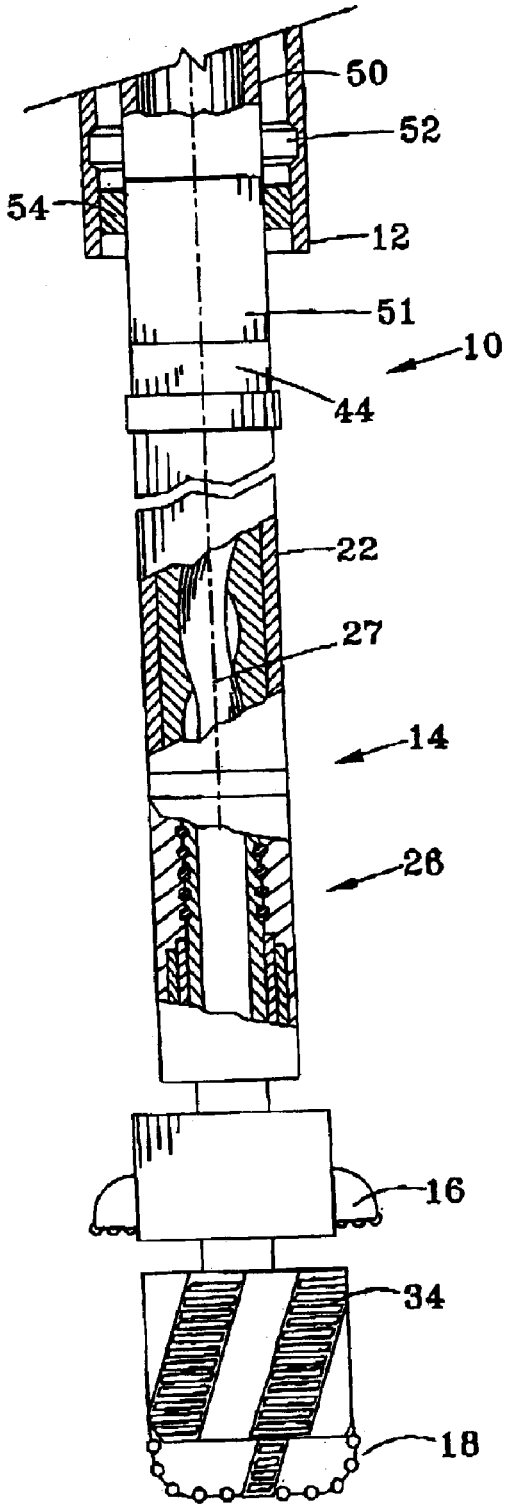
FIG. 5 illustrates a downhole motor without a bend, but with a reamer and a pilot bit.

For the FIG. 5 embodiment, the BHA is not used for directional drilling operations, and accordingly the motor 14 does not have a bend in the motor housing. The motor is, however, powered to rotate the bit, or the casing itself is generally slid in the well, but also may be rotated while the motor is powering the bit. The BHA 50 as shown in FIG. 4 may thus be used for substantially straight drilling operations, with the benefits discussed above.

A significant feature of the present invention is that the BHA allows for the use of casing with conventional threaded connectors, such as API (American Petroleum Institute) connectors commonly used in casing operations which do not involve rotation of the casing string. Conventionally, an API connector 62 shown in FIG. 7 may thus be used for interconnecting the casing joints. This advantage is significant, since then special premium high torque connectors need not be provided on the joints of the casing or the other tubular components of the casing string. Use of conventional components already in stock significantly lowers installation and maintenance costs.

As shown in FIGS. 1 and 5, the MWD package 44 is provided below a lowermost end of the casing 12. The retrievable downhole motor 14 may be powered by passing fluid through the casing, and then into the downhole motor. The motor 14 may be supported from the casing with a latching mechanism 51, which absorbs the torque output from the motor 14. Fluid may be diverted through the latching mechanism, then to the motor and then the reamer and the bit. Those skilled in the art will appreciate the downhole motor may be latched to the casing string 12 by various mechanisms, including the plurality of circumferentially arranged dogs 52 which fit into corresponding slots in the casing 12. A packer or other seal assembly 54 may be provided for sealing between the BHA and the casing string 12. After the hole is drilled, the dogs 52 on the latching mechanism 51 may be hydraulically activated to move to a release position, and the motor 14, the retracted cutting elements in the bit or reamer 16, the gauge section 34, and the pilot bit 18 may then be retrieved to the surface. A retrieving tool similar to those used in multilateral systems may be employed. Alternatively, the reamer cutters may be cut off or otherwise separated from the body of the reamer. A casing shoe at the lower end of the casing string may have the ability to cut off the reamer blades, so that the reamer blades may be cut off rather than retracted, and this option may be used in some applications. In a preferred embodiment, the downhole assembly may be retrieved by the wireline with the casing 12 remaining in the well. Alternatively, a work string 50 may be used to retrieve the motor.

It should also be understood that a pilot bit, gauge section, and reamer as discussed above may be secured at the lower end of the casing string for casing drilling operation when rotating the casing string, which is conventionally rotated when drilling straight sections of the borehole. Significant advantages are, however, realized in many operations to drill at least a portion of the well with the bit or reamer being powered by a downhole motor, sometimes with the casing not rotated to enable drilling directionally. During drilling of the length of the borehole to total depth, TD, the casing may remain in the hole and the bottom hole assembly including the downhole motor and bit returned to the surface for repair or replacement of bits. When the total depth of a well is reached, the downhole assembly may similarly be retrieved to the surface, although in some applications when reaching TD, the bit, reamer, and pilot bit assembly, or the bit assembly and the motor, may remain in the well, and only the MWD assembly retrieved to the surface.

The BHA in the present invention substantially reduces the torque which must be imparted to the casing string 12 when drilling a straight section of the borehole. When rotating casing string 12 within a well, a significant problem concerns "stick-slip", which causes torque spikes along the casing string when rotation is momentarily stopped and then restarted. Undesirable stick-slip forces will likely be particularly high in the upper portion of the drill string, where torque on the casing string 12 imparted at the surface is highest. Since the torque imparted to the casing string 12 according to the present invention is significantly reduced, the consequences of stick-slip of the casing string 12 are similarly reduced, thereby further reducing the robust requirements for the casing connectors.

By using a reduced torque motor in the context of this invention, there is substantially less motor torque, and thus also less "reverse" or reactive torque generated when the bit motor stalls and the bit rotated by the motor suddenly stops. The high peaks of this variable reverse torque causes torque spikes propagating upward from the motor to the lower portion of the casing string. The lower portion of casing string may thus briefly "wind up" when bit rotation is stopped. Reverse torque is thus also reduced, allowing for more economical casing connectors.

Downhole motor is powered to rotate the bit and drill a deviated portion of the well, desirably high rates of penetration often may be achieved by rotating the bit at less than 350 RPM. Reduced vibrations results from the use of a long gauge above the bit face and the relatively short length between the bend and the bit, thereby increasing the stiffness of the lower bearing section. The benefits of improved borehole quality include reduced hole cleaning expense, improved logging operations and log quality, easier casing runs and more reliable cementing operations. The BHA has low vibration, which again contributes to improved borehole quality.

Drilling with casing techniques are currently used on a very low percentage of wells. Efforts to improve borehole quality with a BHA as disclosed in U.S. Pat. No. 6,269,892 and would not solve the primary problem with casing drilling operations, which involves the high cost of the casing string due to special connectors, equipment failure due to vibration, and difficulty with retrieving the downhole motor and bit through the casing string. U.S. Pat. No. 6,470,977 discloses a bottom hole assembly for reaming a borehole. The present invention applies technology directed to a bottom hole assembly which provides for significant improvements in borehole quality, but the benefits of improved borehole quality will be secondary to the significant reduction in costs and increased reliably for successfully completing a casing drilling operation.

The downhole assembly of the present invention is able to drill a hole utilizing less weight on bit and thus less torque than prior art BHAs, and is able to drill a "truer" hole with less spiraling. The casing itself may thus be thinner walled than casing used in prior art casing drilling operations, or may have the same wall thickness but may be formed from less expensive materials. The cost of casing suitable for conventional casing drilling operations is high, and the forces required to rotate the bit to penetrate the formation at a desired drilling rate may be lowered according to this invention, so that less force is transmitted along the casing string to the bit. Since the drilled hole is truer, there is less drag on the casing string, and the operator has more flexibility with respect to the weight on bit to be applied at the surface through the casing string. Since there is less engagement with the borehole wall both when sliding the casing in the hole with the drill motor being powered to form a deviated portion of the wellbore, and when rotating the casing string from the surface to rotate the bit when drilling a straight section of the borehole, there is substantially less Wear on the casing during the drilling operation, which again allows for thinner wall and/or less expensive casing.

The primary advantage of the present invention is that it allows casing drilling operations to be conducted more economically, and with a lower risk of failure. The truer hole produced according to casing drilling using the present invention not only results in lower torque and drag in the well, but reduces the likelihood of the casing becoming stuck in the well. Another significant advantage relates to increased reliability of retrieving the bit through the casing string to the surface. As previously noted, the cutting diameter of the bit or reamer must be greater than the OD of the casing, but the bit must be retrieved through the ID of the casing. Various devices had been devised for insuring easy retrievability, but all devices are subject to failure, which to a large extent is attributable to high vibration of the BHA. High vibrations for the BHA may thus lead to casing connection failures, bit failures, and motor failures, and thus will adversely affect the reliability of the mechanism which requires the bit cutting diameter be reduced to fit within the ID of the casing string, so that the motor and bit may be retrieved to the surface. The relatively smooth wellbore resulting from the BHA of this invention provides for better cementing and hole cleaning. The BHA not only results in reduced costs to run the casing in the well, but also results in better ROP, better steerability, improved reamer reliability, and reduced drilling costs.

According to the prior art, a PDM driving a reamer or bi-centered bit and a conventional pilot bit would be minimally supported radially by the borehole, and thus would be relatively limber, unbalanced, and therefore prone to creating vibration. Further, when rotating this unbalanced assembly, undesirable stick-slip may be high. Since these torque events would often be greater than the rated torque for standard API casing joint connections, and since failure of a connection would be a significant cost, prior art casing drilling has used specially designed, costly, and higher strength casing connectors.

Prior art casing drilling operations require a high amount of torque to be transmitted to the casing string at the surface in order to overcome the static friction and the dynamic friction required to rotate the casing string in the well when drilling a straight section of the borehole. Frictional losses may be significantly reduced utilizing a bottom hole assembly of the present invention, since the truer borehole resulting from the bottom hole assembly reduces the drag between the casing string and the formation.

When the casing is being slid (non-rotating from surface) and the motor is rotating to the bit, there is less torque generation required by the motor using this BHA, by virtue of the pilot bit and the gauge section, and absence of non-constructive bit behaviors. Less aggressive bits and lower torque motors are thus preferred. This combination also reduces reverse torque due to motor stalling. Since a less aggressive bit takes less of a bite out of the rock, and since the pilot bit and gauge section result in each bite being the desired and properly aimed bite, high instantaneous torque and the likelihood of a stall are minimized. If the motor does stall, the low torque motor ensures that the reactive or reverse torque spike is lower, since the reactive torque cannot be any greater than the torque capacity of the motor.

When rotating the casing from the surface for hole cleaning, removal of the directionality, or reducing possibility of differential sticking, there is less top-drive torque being consumed in the interaction between the rotating casing and the wellbore, over the length of the wellbore, due to the smoother wellbore. The smoothness of the borehole, while primarily impacting the rotary torque, also results in better weight transfer to the bit, allowing reduced weight to be applied at the surface, and less weight directly on the bit, thereby reducing the depth of cut and the sticking action of the cutters. The top-drive requires less torque to rotate the casing string, and a far greater proportion of the top-drive generated torque reaches the bit. The torque that the string elements closest to surface must transmit, which otherwise might be very high, is reduced, and casing connectors may be of lesser torque capacity.

According to the present invention, the connectors along the casing string need not be as costly or robust as prior art casing connectors for casing drilling operations. The casing connectors according to this present invention may thus be designed to withstand less torque than prior art casing connectors, and preferably have a yield torque which satisfies the relationship:

$$\text{CCYT ft-lbs} \leqq 5500 \text{ ft-lbs} + 192 \text{ ft-lbs/in}^3(\text{OD in} - 4.5 \text{ in})^3 \quad \text{Equation 1}$$

wherein the casing connector yield torque or CCYT is expressed in foot-pounds, and the casing outer diameter or OD is expressed in inches. The casing connection yield torque is thus the maximum torque which may be applied to the connector, since torque in excess of that value theoretically may result in the connector yielding and thus failing, either mechanically (possible separation of the casing string) on hydraulcally (possible fluid leakage past or through the connection). In vertical or low inclination wells, the normal force of the casing string on the wall of the wellbore is small, so the yield torque would be proportional to casing OD. In high inclination wells, however, the normal force is substantially the weight of casing, which is a function of the steel density and the square of the casing diameter. In horizontal wells, the yield torque would be proportional to the cube of the casing string OD. The connection yield torque may thus be set for the worse case, i.e., a horizontal well, then used in a vertical well, a well slightly inclined at less than about 5°, and in a horizontal or substantially horizontal well. For many casing drilling applications, the CCYT according to the present invention may be significantly less than the prior art, and may be defined by the relationship:

$$\text{CCYT ft-lbs} \leqq 5500 \text{ ft-lbs} + 144 \text{ ft-lbs/in}^3(\text{OD in} - 4.5 \text{ in})^3 \quad \text{Equation 2}$$

which is approximately 60% of the connector yield torque capability of torque connectors commonly used in casing drilling operations. In still other apllications, the connector yield torque may be defined by the relationship:

$$\text{CCYT ft-lbs} \leqq 5500 \text{ ft-lbs} + 96 \text{ ft-lbs/in}^3(\text{OD in} - 4.5 \text{ in})^3 \quad \text{Equation 3}$$

In some shallow well and/or vertical well applications, the reduced drag of the casing string on the borehole and the use of a comparatively low torque rating motor may allow for even lower torque ratings for the connectors, satisfying the relationship:

$$\text{CCYT ft-lbs} \leqq 5500 \text{ ft-lbs} + 48 \text{ ft-lbs/in}^3(\text{OD in} - 4.5 \text{ in})^3 \quad \text{Equation 4}$$

Figure 6:
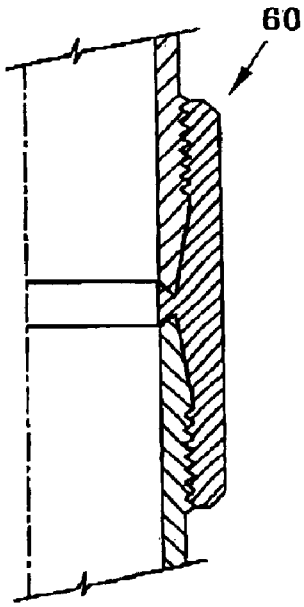
FIG. 6 illustrates a low cost casing connector for use along the casing string according to this invention.
Figure 7:
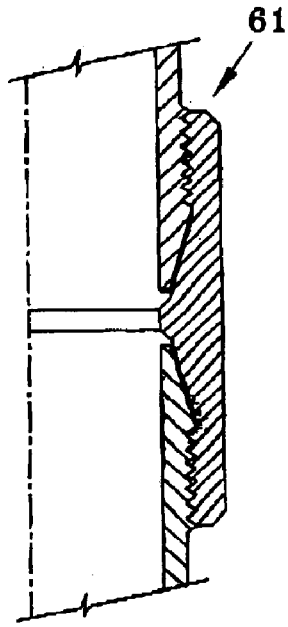
FIG. 7 illustrates an API casing connector for use along the casing string.

According to the invention, the BHA is much less prone to this torque spiking, and the PDM used may have a comparatively low torque rating. Further, the casing joint connectors do not require special high strength, and in some embodiments may have strength comparable to or may be the standard API connectors (API RP 5C1, 18th Edition, 1999). FIG. 6 depicts a casing connector 60 according to the present invention which includes a tapered shoulder on the coupling for engagement with a lower end of an upper casing joint and an upper end of a lower casing joint, although the casing joint connectors 60 as shown in FIG. 6 need not be as costly or robust as prior art drilling with casing connectors. FIG. 7 shows an alternative casing connector 61 with a coupling connecting upper and lower joints, and tapered seal surfaces on the end of each joint engaging a mating surface on the coupling.-Connector 61 as shown in FIG. 7 may thus be similar to an API connection. This, and the reduced likelihood of connection failures, represents a significant cost savings.

According to the method of the invention, the bottom hole assembly with the downhole motor as discussed above is assembled for use in a casing drilling operation. When making up the connectors of the casing string, the makeup torque on the threaded connectors is controlled to be less than the yield torque which satisfies Equation 1, and preferably less than the yield torque which satisfies Equation 2. In many operations, the make-up torque may be even further reduced to be less than the yield torque which satisfies Equation 3, and in some applications the make-up torque may be sufficiently low to satisfy Equation 4. The threaded joints of the casing string are thus made up to a selected make-up torque which is less than the yield torque, and may be selectively controlled to a desired level by controlling the maximum output from the power tongs which supply the make-up torque. Make-up torque for the casing string connectors preferably is recorded to ensure that the make-up torque for each of the connectors is less than the yield torque.

Yet another benefit of the present invention is that the size of the bit (reamer) may be reduced. Table 1 gives specific dimensions for a pilot bit and reamer in the open position. The hole enlargement is in excess of 40% between the pilot bit and the open reamer. If the hole enlargement can be reduced, significant savings would inherently result by drilling a smaller diameter borehole. The reamer hole diameter according to the prior art is in excess of about 125%, and most commonly about 130%, of the casing OD. Table 2 depicts the same casing, with the same pilot bit size, and provides for the smaller diameter reamer which results in a significant reduction in hole enlargement. As indicated in Table 2, hole enlargement may be less than 40% and, in many cases, less than about 35%. The ratio of the reamed hole diameter to the casing OD as shown in Tables 1 and 2, which is 122% or less, preferably 120% or less, and commonly about 115% or less than the casing OD according to this invention, points out the significant advantages of this invention over the prior art.

TABLE 1

| Casing Size (inches) | Pilot Bit Size (inches) | Reamer (open) (inches) | Hole Enlargement | Reamed Hole/ Casing OD |
|---|---|---|---|---|
| 13⅜ | 12¼ | 17½ | 43% | 131% |
| 9⅝ | 8½ | 12¼ | 44% | 128% |
| 7⅝ | 6¼ | 10 | 60% | 132% |
| 5½ | 4¾ | 6⅞ | 45% | 125% |

TABLE 2

| Casing Size (inches) | Pilot Bit Size (inches) | Reamer (open) (inches) | Hole Enlargement | Reamed Hole/ Casing OD |
|---|---|---|---|---|
| 13⅜ | 12¼ | 16 | 31% | 120% |
| 9⅝ | 8½ | 11 | 29% | 114% |
| 7⅝ | 6¼ | 8½ | 36% | 115% |
| 5½ | 4¾ | 6⅛ | 29% | 112% |

Reducing hole enlargement will therefore increase rate of penetration, and improve reamer reliability both when cutting and when being retrieved though the casing, and will significantly reduce drilling costs.

It will be understood by those skilled in the art that the embodiment shown is exemplary, and that various modifications may be made in the practice of the invention. Accordingly, the scope of the invention should be understood to include such modifications which are within the spirit of the invention, as defined by the following claims.

What is claimed is:

1. A method of drilling a bore hole utilizing a bottom hole assembly including a downhole motor having an upper power section with a power section central axis and a lower bearing section with a lower bearing central axis offset at a selected bend angle from the power section central axis by a end, the bottom hole assembly further including a bit rotatable by the motor and having a bit face defining a bit cutting diameter greater than an outer diameter of a casing string run in the well with the bottom hole assembly, the method comprising:

securing a gauge section below the bit, the gauge section having uniform diameter bearing surface thereon along an axial length of at least about 60% of a pilot diameter, the bit diameter being less than about 122% of the casing string outer diameter;

providing the pilot bit secured to and below the gauge section; and rotating the bit, the gauge section and the pilot bit by pumping fluid through the downhole motor to drill the borehole.

2. The method as defined in claim 1, wherein the bit is a reamer secured to and above the gauge section, such that the bit face is the reamer face.

3. A method as defined in claim 1, wherein the gauge section has an axial length of at least 75% of the pilot bit diameter.

4. A method as defined in claim 1, wherein a portion of the gauge section which has the substantially uniform diameter rotating cylindrical bearing surface is no less than about 50% of the axial length of the gauge section.

5. A method as defined in claim 1, further comprising:

providing a pin connection at a lower end of the downhole motor; and providing a box connection at an upper end of the bit for mating interconnection with the pin connection.

6. A method as defined in claim 1, further comprising:

providing cutters on the bit which radially move between an outward position for cutting a borehole greater than an outer diameter of the casing and a retrieval position wherein the downhole motor and bit are retrieved to the surface.

7. A method as defined in claim 1, wherein hole enlargement from the bit is less than about 40% greater than the pilot bit diameter.

8. A method as defined in claim 7, wherein hole enlargement from the bit is less than about 30% greater than the pilot bit diameter.

9. A method as defined in claim 1, wherein the bit is a bi-centered bit secured to and above the gauge section, such that the bit face is the bi-centered bit face.

10. A method as defined in claim 1, further comprising:

axially spacing the bend from the bit face less than fifteen times the bit diameter.

11. A method of drilling a bore hole utilizing a bottom hole assembly including a downhole motor having an upper power section with a power section central axis and a lower bearing section with a lower bearing central axis offset at a selected bend angle from the power section central axis by a bend, the bottom hole assembly further including a reamer rotatable by the motor and having a reamer face and reamer cutters defining a reamer cutting diameter greater than an outer diameter of a casing string run in the well with the bottom hole assembly, the method comprising:

securing a gauge section below the reamer, the gauge section having a uniform diameter bearing surface thereon along an axial length of at least 60% of a pilot bit diameter, the reamer cutting diameter being less than about 40% greater than the pilot bit diameter;

axially spacing the bend from the reamer face less than fifteen times the reamer cutting diameter;

providing the pilot bit secured to and below the gauge section;

rotating the pilot bit, the gauge section and the reamer by pumping fluid through the downhole motor to drill the borehole;

selectively either retracting or disconnecting the reamer cutters; and thereafter retrieving at least one of the downhole motor, the reamer, the gauge section and the pilot bit from the well while leaving the casing string in the well.

12. A method as defined in claim 11, wherein the gauge section has an axial length of at least 75% of the pilot bit diameter.

13. A method as defined in claim 11, further comprising:

providing a pin connection at a lower end of the downhole motor; and providing a box connection at an upper end of the reamer for mating interconnection with the pin connection.

14. A method as defined in claim 11, further comprising:

providing reamer cutters which radially move between an outward position for cutting a borehole greater than an outer diameter of the casing and a retrieval position wherein the bottom hole assembly is retrieved to the surface.

15. A system for drilling a bore hole utilizing a bottom hole assembly including a downhole motor having an upper power section with a power section central axis and a lower bearing section with a lower bearing central axis offset at a selected bend angle from the power section central axis by a bend, the bottom hole assembly further including a bit rotatable by the motor and having a bit face defining a bit cutting diameter greater than an outer diameter of a casing string run in the well with the bottom hole assembly, the system further comprising:

casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3 (\text{OD in} - 4.5 \text{ in})^3$$

wherein CCYT is casing connector yield torque in foot pounds, and OD is the outer diameter of the casing string joints in inches;

a gauge section secured below the bit, the gauge section having uniform diameter bearing surface thereon along an axial length of at least 60% of a pilot bit diameter;

the pilot bit secured to and below the gauge section; and at least one of the downhole motor, the bit, the gauge section and the pilot bit are retrieved from the well while leaving the casing string in the well.

16. A system as defined in claim 15, further comprising:

the bend is spaced from the bit face less than fifteen times the bit diameter.

17. A system as defined in claim 15, further comprising:

a pin connection at a lower end of the downhole motor; and a box connection at an upper end of the bit for mating interconnection with the pin connection.

18. A system as defined in claim 15, further comprising:

cutters on the bit radially movable between an outward position for cutting a borehole greater than an outer diameter of the casing and a retrieval position wherein the bottom hole assembly is retrieved to the surface.

19. A method of drilling a bore hole utilizing a bottom hole assembly including a downhole motor having an upper power section and a lower bearing section, the bottom hole assembly further including a bit rotatable by the motor and having a bit face defining a bit cutting diameter greater than a outer diameter of a casing string run in the well with the bottom hole assembly, the method comprising:

providing casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3 (\text{OD in} - 4.5 \text{ in})^3$$

wherein CCYT is casing connector yield torque in foot pounds, and OD is the outer diameter of the casing string joints in inches;

securing a gauge section below the bit, the gauge section having a uniform diameter bearing surface thereon along an axial length of at least 60% of a pilot bit diameter;

providing a pilot bit having the pilot bit diameter secured to and below the gauge section;

selectively rotating the bit, the gauge section and the pilot bit by pumping fluid through the downhole motor to drill the borehole, and thereafter retrieving at least one of the downhole motor, the bit, the gauge section and the pilot bit from the well while leaving the casing string in the well.

20. The method as defined in claim 19, wherein the bit is a reamer secured to and above the gauge section, such that the bit face is the reamer face.

21. A method as defined in claim 19, wherein the gauge section has an axial length of at least 75% of the pilot bit diameter.

22. A method as defined in claim 19, further comprising:

supplying a make-up torque to the casing connectors to threadably interconnect the casing joints along the casing string, the make-up torque being less than the casing connector yield torque.

23. A method as defined in claim 19, further comprising:

providing cutters on the bit which radially move between an outward position for cutting a borehole greater than an outer diameter of the casing and a retrieval position wherein the downhole motor and bit are retrieved to the surface.

24. A method as defined in claim 19, wherein the bit is a bi-centered bit secured to and above the gauge section, such that the bit face is the bi-centered bit face.

25. A method as defined in claim 19, wherein the casing connectors satisfy the relationship $$\text{CCYT ft-lbs} \leqq 5500 \text{ ft-lbs} + 192 \text{ ft-lbs/in}^3(\text{OD in} - 4.5 \text{ in})^3.$$

26. A method of drilling a bore hole utilizing a bottom hole assembly including a downhole motor having an upper power section and a lower bearing section, the bottom hole assembly further including a reamer rotatable by the motor and having a reamer face defining a reamer cutting diameter greater than an outer diameter of a casing string run in the well with the bottom hole assembly, the method comprising:

securing a gauge section below the reamer, the gauge section having a uniform diameter bearing surface thereon along an axial length of at least 60% of a pilot bit diameter;

providing a pilot bit having the pilot bit diameter secured to and below the gauge section, the hole enlargement from the reamer being less than 40% greater than the pilot bit diameter;

selectively rotating the reamer, the gauge section and the pilot bit by pumping fluid through the downhole motor to drill the borehole; and retrieving at least one of the downhole motor, the reamer, the gauge section and the pilot bit from the well while leaving the casing string in the well.

27. A method as defined in claim 26, further comprising:

the gauge section has an axial length of at least 75% of the pilot bit diameter.

28. A method as defined in claim 26, further comprising:

providing cutters on the reamer which radially move between an outward position for cutting a borehole greater than an outer diameter of the casing and a retrieval position wherein the downhole motor and bit are retrieved to the surface.

29. A method as defined in claim 26, further comprising:

providing casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3(\text{OD in} - 4.5 \text{ in})^3$$

wherein CCYT is casing connector yield torque in foot pounds, and OD is the outer diameter of the casing string joints in inches.

30. A method as defined in claim 29, wherein the casing connectors satisfy the relationship $$\text{CCYT ft-lbs} \leqq 5550 \text{ ft-lbs} + 144(\text{OD in} - 4.5 \text{ in})^3.$$

31. A method as defined in claim 25, wherein a portion of the gauge section which has the substantially uniform diameter rotating cylindrical bearing surface is no less than about 50% of the axial length of the gauge section.

32. A system for drilling a bore hole utilizing a bottom hole assembly including a downhole motor having an upper power section and a lower bearing section, the bottom hole assembly further including a bit rotatable by the motor and having a bit face defining a bit cutting diameter greater than an outer diameter of a casing string run in the well with the bottom hole assembly, the system further comprising:

a gauge section secured below the bit, the gauge section having a uniform diameter bearing surface thereon along an axial length of at least 75% of a pilot bit diameter, and the bit cutting diameter being less than about 40% greater than the pilot bit diameter;

a pilot bit having the pilot bit diameter secured to and below the gauge section; and at least one of the downhole motor, the bit, the gauge section and the pilot bit being retrievable from the well while leaving the casing string in the well.

33. A system as defined in claim 32, further comprising:

a pin connection at a lower end of the downhole motor; and a box connection at an upper end of the bit for mating interconnection with the pin connection.

34. A system as defined in claim 32 further comprising:

cutters on the bit radially movable between an outward position for cutting a borehole greater than an outer diameter of the casing and a retrieval position wherein the bottom hole assembly is retrieved to the surface.

35. A system as defined in claim 32, further comprising:

casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3(\text{OD in} - 4.5 \text{ in})^3$$

wherein CCTR is casing connector yield torque in foot pounds, and OD is the outer diameter of the casing string joints in inches.

36. A system as defined in claim 35, wherein the casing connectors satisfy the relationship $$\text{CCYT ft-lbs} \leqq 5550 \text{ ft-lbs} + 144 \text{ ft-lbs/in}^3(\text{OD in} - 4.5 \text{ in})^3.$$

37. A system as defined in claim 35, wherein the casing connectors satisfy the relationship $$\text{CCYT ft-lbs} \leqq 5550 \text{ ft-lbs} + 96 \text{ ft-lbs/in}^3(\text{OD in} - 4.5 \text{ in})^3.$$

38. A method as defined in claim 26, further comprising:

axially spacing the bend from the reamer face less than fifteen times the reamer cutting diameter.

39. A system as defined in claim 32, wherein the bit cutting diameter is less than about 122% of the casing string outer diameter.

* * * * *

UNITED STATES PATENT AND TRADEMARK OFFICE

CERTIFICATE OF CORRECTION

PATENT NO. : 6,877,570 B2
DATED : April 12, 2005
INVENTOR(S) : Chen-Kang D. Chen and M. Vikram Rao It is certified that error appears in the above-identified patent and that said Letters Patent is hereby corrected as shown below:

Column 10,
Line 38, delete "end" and insert therefor -- bend --.

Signed and Sealed this

Fourteenth Day of June, 2005

JON W. DUDAS
*Director of the United States Patent and Trademark Office*